US006128844A

United States Patent [19]

Stermer et al.

[11] Patent Number: 6,128,844

[45] Date of Patent: Oct. 10, 2000

[54] PLASTIC DISPLAY DEVICE

[76] Inventors: Frederick A. Stermer, 1321 Leafydale Dr.; Jonathan F. Stermer, 1473 Wayne Ave., both of York, Pa. 17403

[21] Appl. No.: 09/351,135

[22] Filed: Jul. 12, 1999

Related U.S. Application Data

[60] Provisional application No. 60/095,431, Aug. 5, 1998.

[51] Int. Cl.[7] ..... G09F 3/20

[52] U.S. Cl. ..... 40/658; 40/124; 24/196

[58] Field of Search ..... 40/124, 617, 640, 40/658, 666; 24/16 R, 183, 196

[56] References Cited

U.S. PATENT DOCUMENTS

| | | | |
|---|---|---|---|
| D. 267,533 | 1/1983 | Phillips . | |
| D. 311,457 | 10/1990 | Shapiro . | |
| 835,178 | 11/1906 | Clare . | |
| 1,621,259 | 3/1927 | Lane | 40/666 |
| 2,278,695 | 4/1942 | Fluss | 40/124 |
| 2,939,234 | 6/1960 | Hill . | |
| 3,309,805 | 3/1967 | Thomas . | |
| 3,462,863 | 8/1969 | Reeves | 40/658 X |
| 3,797,150 | 3/1974 | Hinckley . | |
| 4,326,349 | 4/1982 | Daughtry . | |
| 4,654,991 | 4/1987 | Jones | 40/124 X |
| 5,242,062 | 9/1993 | Engravalle . | |
| 5,535,976 | 7/1996 | Gruneisen, III . | |
| 5,651,166 | 7/1997 | Lundstedt | 24/196 X |
| 5,718,402 | 2/1998 | Hoffman et al. . | |

FOREIGN PATENT DOCUMENTS

| | | | |
|---|---|---|---|
| 136622 | 12/1919 | United Kingdom . | |
| 86/00200 | 1/1986 | WIPO | 24/196 |

*Primary Examiner*—Brian K. Green
*Attorney, Agent, or Firm*—Richard C. Litman

[57] ABSTRACT

The plastic display device is a device for conveniently displaying cards, photographs, menus, letters and the like. The device is constructed of plastic and comprises an integral rectangular frame, buckle portion having three parallel rods, and clip. The clip is attached to the top edge of the frame and extends parallel to the frame defining a slot, and has a lip projecting rearward towards the frame. The clip flexes to allow the clip to accommodate an edge of a card inserted in the slot. The rods of the buckle portion are configured to allow a flat, flexible strip such as a ribbon to be threaded thereabout. A plurality of display devices may be mounted on a single ribbon. The ribbon may be mounted to a wall or other flat surface to display cards and other like materials.

13 Claims, 2 Drawing Sheets

PLASTIC DISPLAY DEVICE

CROSS-REFERENCE TO RELATED APPLICATION

This application claims the benefit of U.S. Provisional Patent Application Serial No. 60/095,431, filed Aug. 5, 1998.

BACKGROUND OF THE INVENTION

1. Field of the Invention

The present invention relates to plastic display devices, and more particularly to card display devices threadedly attached to a flexible strip of material and mounted onto a flat surface.

2. Description of Related Art

Greeting cards, postcards, photographs and the like are a common form of social expression. Oftentimes, such cards and photos are stacked in a pile and must be sorted to be enjoyed. Other times, greeting cards may be placed on a horizontal surface, where they are prone to falling over. Cards and other items desired for display may also be affixed to a wall or similar flat surface. However, not all of these surfaces are appropriate, as nailing or drilling may be required.

Card-holding devices are well known in the prior art. One such device is described in U.S. Pat. No. Des. 311,457 which issued to H. Shapiro on Oct. 23, 1990. This patent discloses a clip-on picture holder comprising a envelope-type piece of transparent plastic for maintaining a photograph. No means for mounting the clip to either a vertical or horizontal surface is shown. U.S. Des. Pat. No. 267,533, issued Jan. 11, 1983 to J. H. Phillips, shows a flat plate with an L-shaped foot for mounting on a vertical surface, the plate having a plurality of slots for receiving greeting cards.

U.S. Pat. No. 835,178 which issued to W. A. B. Clare on Nov. 6, 1906, discloses a card holder for pictorial postcards and the like. This invention comprises a strip of stiff material, either cardboard or metal, having a plurality of opposed tongues for receiving a postcard therebetween. Flexibility is imparted to the tongues by small holes formed at the ends of the slits forming the tongues. Similarly, U.S. Pat. No. 2,939,234 which issued to H. L. Hill on Jun. 7, 1969, discloses a card display rack comprising a plurality of spring clamps mounted to an elongated strip of flexible material, each spring clamp configured and dimensioned to hold a card.

U.S. Pat. No. 3,309,805 which issued to J. B. Thomas on Mar. 21, 1967, discloses a holder for cards and the like, comprising a transparent rectangular sheet having a plurality of card-receiving pockets, each pocket configured to hold a card therein. U.S. Pat. No. 3,797,150 which issued to S. B. Hinckley on Mar. 19, 1974, discloses a display apparatus consisting of a strip of felt material containing partitions enabling a plurality of cards to be displayed. The device has a loop formed at the top of the strip through which a rod may be inserted for hanging the strip.

U.S. Pat. No. 4,326,349 which issued to G. A. Daughtry on Apr. 27, 1982, discloses a greeting card display device comprising a plurality of leaves hinged about an axis, each leaf having an opening for receiving a card therein, the leaves having support feet for resting on a horizontal surface.

U.S. Pat. No. 5,242,062 which issued to L. K. Engravalle on Sep. 7, 1993, discloses a display for greeting cards comprising a flat, thin display member having a plurality of slots adapted to receive a respective card. The device may also be affixed to a flat surface such as a wall.

U.S. Pat. No. 5,535,976 which issued to A. H. Gruneisen, III on Jul. 16, 1996, discloses a card holder for use on tables in restaurants and the like. The device comprises a stand and a clip detachable therefrom, whereupon a card is removably secured therebetween.

U.S. Pat. No. 5,718,402 which issued to Hoffman et al. on Feb. 17, 1998, discloses an elongated extruded plastic clip for hanging signs or posters. The clip comprises a leg and base connected by a bridging portion, whereupon a poster may be inserted between the leg and base portions.

Lastly, British Patent No. 136,622, published Dec. 16, 1919, discloses a means for holding and suspending postcards and the like, comprising a plurality of rigid metal clips, each clip having transverse slots for threading onto a suspended linen tape. Each clip additionally has a pair of ears on each side at the top and bottom of the clip. Cards are held between the ears and the tape by means of tension maintained on the tape by a weight placed at the bottom of the tape, which presses the ears against the tape.

None of the above inventions and patents, taken either singly or in combination, is seen to describe the instant invention as claimed.

SUMMARY OF THE INVENTION

The plastic display device is a device for conveniently displaying cards, photographs, menus, letters and the like. The device is constructed of plastic and comprises an integral rectangular frame, buckle portion having three parallel rods, and clip. The clip is attached to the top edge of the frame and extends parallel to the frame defining a slot, and has a lip projecting rearward towards the frame. The clip flexes to allow the clip to accommodate an edge of a card inserted in the slot. The rods of the buckle portion are configured to allow a flat, flexible strip such as a ribbon to be threaded thereabout. A plurality of display devices may be mounted on a single ribbon. The ribbon may be mounted to a wall or other flat surface to display cards and other like materials.

Because of its ease of manufacture and strong grip on cards and the like, the display device is ideal for displaying greeting cards, photographs, crepe paper, menus and the like. Because of its convenience, the display device is ideal for use while on the go or in the home, office, hospital or nursing facility, family gatherings and many other locations.

Accordingly, it is a principal object of the invention to provide a display device for conveniently holding cards, photos and the like.

It is another object of the invention to provide a display device that may be removably mounted to a flat surface such as a wall.

It is a further object of the invention to provide a display device that may easily and efficiently be manufactured and marketed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
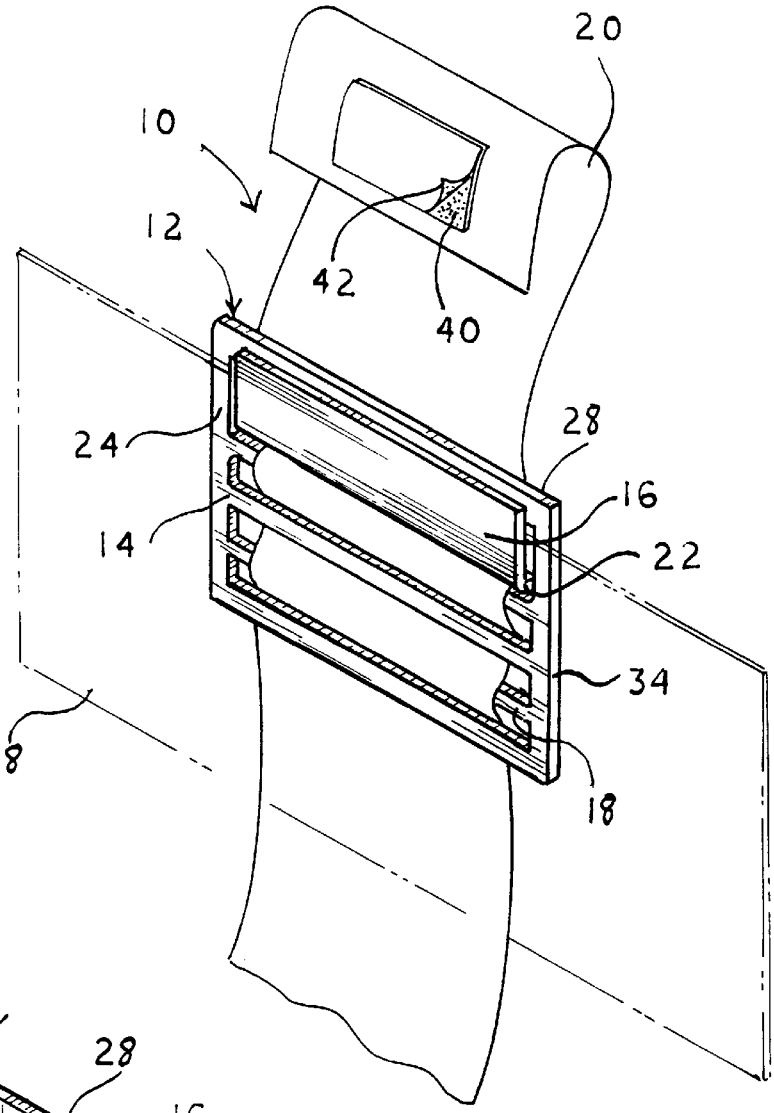
FIG. 1 is an environmental, perspective view of a display device and mounting ribbon according to the present invention, further showing a card mounted in phantom lines.
Figure 2:
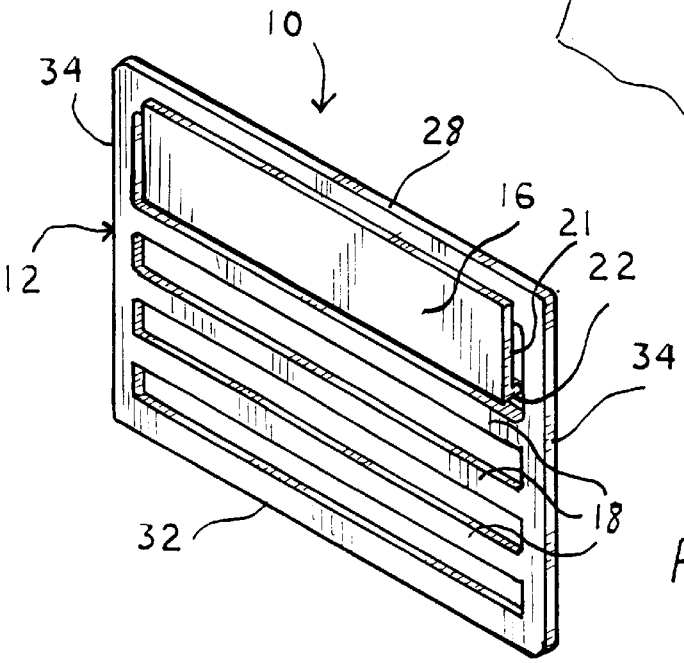
FIG. 2 is a perspective view of the display device according to the present invention.
Figure 3:
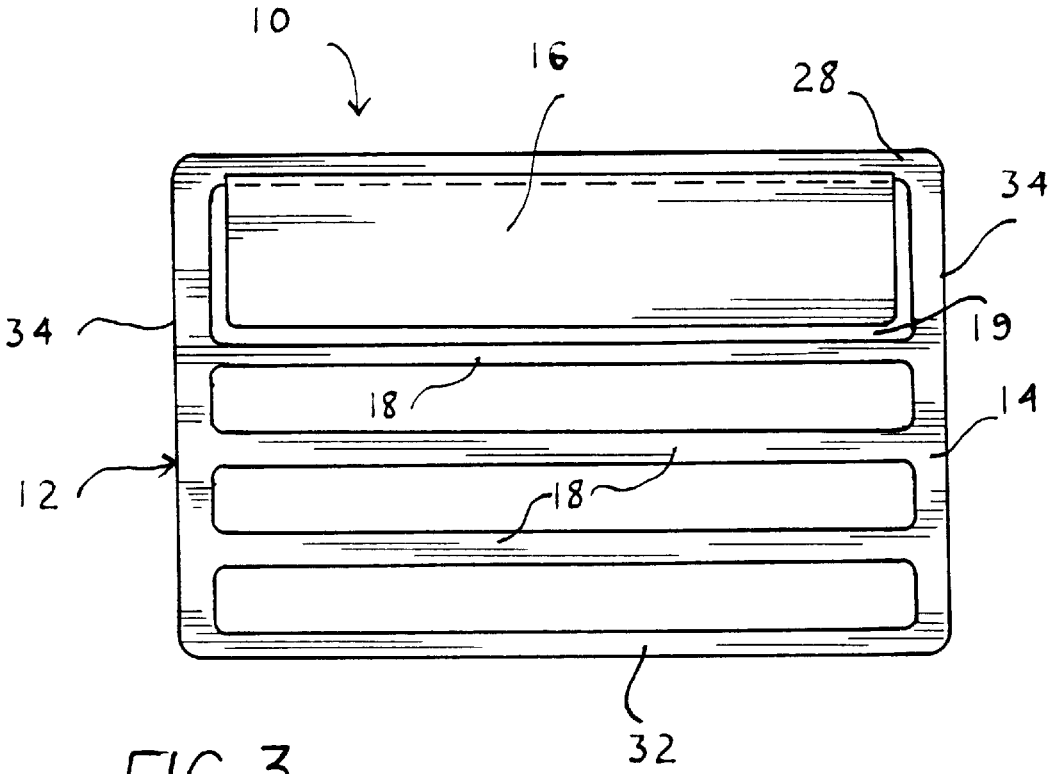
FIG. 3 is a plan view of the display device according to the present invention.

Referring now to the drawings wherein like numerals represent like elements, FIGS. 1–4 show a display device 10 according to the preferred embodiment of the present invention. The device 10 is intended to display photographs, postcards, menus and similar materials. The device comprises 10 an integral, one-piece body, including a generally rectangular frame 12, a buckle portion 14 and clip portion 16. The frame 12 has a front surface 24 and a rear surface 26, a top edge 28, a bottom edge 32 and opposed side edges 34. The clip portion 16 is mounted to the top edge 28 of the frame 12. The buckle portion 14 is affixed to the frame, between the opposing side edges 34 and beneath the clip portion 16.

Figure 4:
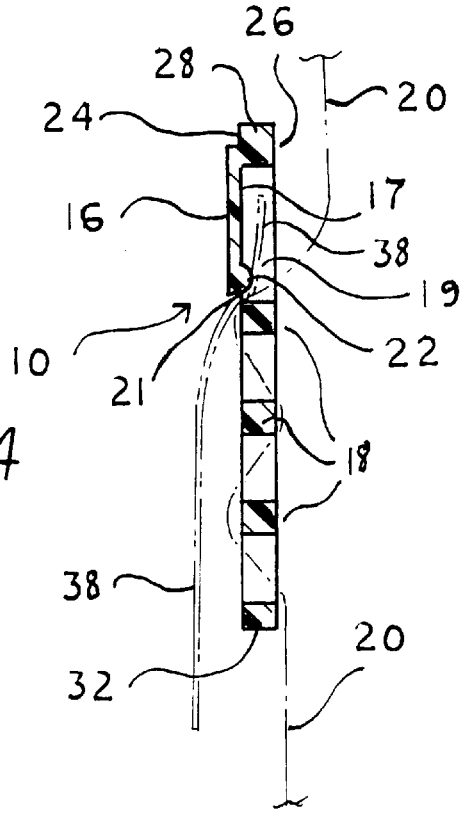
FIG. 4 is a sectional side view of the display device according to the present invention, shown holding a card and with the mounting ribbon threaded therethrough.

The buckle portion 14 has three parallel rods 18 extending between the side edges 34 of the frame 12 arranged from top to bottom, the rods 18 configured to allow a flat, flexible strip such as a mounting ribbon 20 made from cloth fabric to be threaded thereabout, shown in FIGS. 1 and 4, although other flat flexible strips may be used in alternative embodiments. The mounting ribbon 20 has opposed top and bottom ends, the top end having a piece of hook-and-loop-type fastening fabric 40 affixed thereto.

The clip portion 16 is flat and planar plate, having a generally rectangular shape. The clip portion 16 depends from the top edge 28 of the frame 12, and is offset from the frame 12 so that the rear surface 17 of the clip 16 is coplanar with the front surface 24 of the frame 12. The top edge 28 of the frame 12, the top rod 18, and the opposing side edges 34 of the frame 12 define an aperture 19. The rear surface 17 of the clip 16 and the front surface 24 of the frame 12 define a slot 21 into which the edge of a card, photograph, or other flat object may be inserted. The bottom edge of the clip portion 16 has a bead or lip 22 projecting rearward into the aperture 19.

To use the display device 10 of the present invention, the mounting ribbon 20 is first inserted through the rear of the frame 12, intermediate the lip 22 and the topmost rod 18, and alternately threaded about the remaining rods 18 and the bottom edge 32 of the frame, as shown in FIGS. 1 and 4. To display multiple cards, multiple devices 10 may be used in series along a single mounting ribbon 20.

The mounting ribbon 20 may be removably affixed to a wall, ceiling or other flat surface by securing the hook-and-loop-type fastening fabric 40 of the top end in mating engagement with a complimentary piece of hook-and-loop-type fastening fabric 42, which in turn is affixed to the wall by adhesive or other suitable attachment means. The card 38 is affixed to the device 10 by inserting an edge of the card into the slot 21 between the lip 22 of the clip portion 16 and the front surface 24 of the frame 12. The clip portion 16 is biased to remain substantially parallel to the frame 12, but is sufficiently flexible and resilient to yield when the device 10 accepts a card. Once the card 38 is inserted, the lip 22 presses rearward on the card into the aperture 19 to provide a secure grip. Thereafter, the card 22 is removably maintained intermediate the lip 22 of the clip portion 16 and the front surface 24 of the frame 12.

The plastic display device 10 is preferably made as an integral, one-piece body from a thermoplastic material, including, but not limited to, polyethylene, polypropylene, nylon, or polystyrene. The body of the display device 10 may be made economically by injection molding. The joint between the top edge 24 of the frame 12 and the clip 16 imparts sufficient flexibility and resiliency to the clip 16 so that the clip 16 is normally disposed parallel to the frame 12 with the rear surface 17 of the clip 16 substantially coplanar with the front surface 24 of the frame 12 when no force is applied to the clip 16, but has sufficient flexibility that the card 38 may be inserted between the clip 16 and the front surface of the frame 12, and sufficient resiliency to maintain the card 38 in place by compression between the lip 22 and the frame 12.

Representative dimensions of the frame 10 may be about 1.5 inches high by 2.25 inches wide by 0.1 inches thick. The aperture 19 may be about 0.477 inches high by 2.05 inches wide by 0.100 inches deep. The clip 16 may be about 0.45 inches high by 1.95 inches wide by about 0.039 inches thick. The lip 22 may have a radius of curvature of about 0.046 inches. It will be understood that the dimensions above recited are by way of illustrating enablement of the invention, and not by way of limitation.

It will be seen that the plastic display device 10 of the present invention provides a convenient means for displaying cards upon any vertical surface. The ribbon 20 may be attached to the vertical surface without the use of tools. The ribbon 20 may be selected to have a length sufficient to accommodate the desired number of plastic display devices 10. Since the cards, photographs, or other material to be displayed are retained by the compressive force of the clip 16 against the frame 12, it is unnecessary to hang a weight from the bottom of the ribbon 20 to maintain the ribbon 20 taut. Hence, the plastic display device 10 provides a convenient, portable, and economical means for displaying cards, photographs, and the like.

It is to be understood that the present invention is not limited to the sole embodiment described above, but encompasses any and all embodiments within the scope of the following claims.

We claim:

1. A plastic display device for displaying cards and photographs, comprising an integral, one-piece body, including:

a) a rectangular frame having a top edge, a bottom edge, a pair of opposing side edges, a front surface and a rear surface, the frame including a buckle portion comprising at least one rod extending between the opposing side edges of said frame to define at least one aperture; and b) a clip depending from the front surface adjacent the top edge of said frame, the clip having a planar body with a bottom portion and a rear surface substantially coplanar with the front surface of said frame, the clip and the front surface of said frame defining a slot adapted to receive a flat edge of a card, the clip being flexibly and resiliently attached to said frame, the clip further having a lip extending across the rear surface of the body and projecting rearward from the bottom portion of the clip into said at least one aperture, the clip exerting a resilient pressure adapted for clamping an edge of a card between the lip and said frame.

2. The plastic display device according to claim 1, wherein said at least one rod includes three parallel rods extending between the opposing side edges of said frame, said three rods including a top rod, a middle rod, and a bottom rod, wherein the top rod, the top edge of said frame, and the opposing side edges of said frame define the at least one aperture.

3. The plastic display device according to claim 1, wherein the plastic display device is made from a thermoplastic material.

4. The plastic display device according to claim 1, wherein the plastic display device is made from polyethylene.

5. The plastic display device according to claim 1, wherein the plastic display device is made from polypropylene.

6. The plastic display device according to claim 1, wherein the plastic display device is made from nylon.

7. The plastic display device according to claim 1, wherein the plastic display device is made from polystyrene.

8. The display device according to claim 1 further comprising a ribbon threadedly mounted through said buckle portion.

9. The display device according to claim 8, wherein said ribbon further comprises a strip of hook and loop fastening material fixedly attached thereto adapted for attaching said ribbon to a cooperating strip of hook and loop fastening material adhesively attached to a vertical surface.

10. The display device according to claim 8, wherein a plurality of said plastic display devices are mounted on said ribbon.

11. A plastic display device for displaying cards and photographs, comprising:

a) an integral, one-piece body, including:

i) a rectangular frame having a top edge, a bottom edge, a pair of opposing side edges, a front surface and a rear surface, the frame including a buckle portion comprising at least one rod extending between the opposing side edges of said frame to define at least one aperture; and ii) a clip depending from the front surface adjacent to the top edge of said frame, the clip having a planar body with a bottom portion and a rear surface substantially coplanar with the front surface of said frame, the clip and the front surface of said frame defining a slot adapted to receive a flat edge of a card, the clip being flexibly and resiliently attached to said frame, the clip further having a lip extending across the rear surface of the body and projecting rearward from the bottom portion of the clip into said at least one aperture, the clip exerting a resilient pressure adapted for clamping an edge of a card between the lip and said frame; and b) a flat, flexible strip, the strip being threaded through said buckle portion.

12. The plastic display device according to claim 11, wherein said flat, flexible strip is a ribbon made from a cloth fabric.

13. The plastic display device according to claim 11, further comprising means for mounting said flat, flexible strip to a vertical surface.

* * * * *